US006449887B1

(12) United States Patent
Song

(10) Patent No.: US 6,449,887 B1
(45) Date of Patent: Sep. 17, 2002

(54) WATER GLOBE WITH TOUCH SENSITIVE SOUND ACTIVATION

(75) Inventor: Jin K. Song, 2316 Woodfield Way, Bedford, TX (US) 76021

(73) Assignee: Jin K. Song, Bedford, TX (US)

( * ) Notice: Subject to any disclaimer, the term of this patent is extended or adjusted under 35 U.S.C. 154(b) by 0 days.

(21) Appl. No.: 09/558,259

(22) Filed: Apr. 25, 2000

Related U.S. Application Data

(60) Provisional application No. 60/147,946, filed on Aug. 6, 1999.

(51) Int. Cl.[7] ..... G09F 19/00
(52) U.S. Cl. ..... 40/406; 40/410
(58) Field of Search ..... 40/406, 407, 409, 40/410; 446/267, 397; 273/161; 84/94.2, 95.2

(56) References Cited

U.S. PATENT DOCUMENTS 3,798,833 A * 3/1974 Campbell ..... 446/130
4,765,623 A * 8/1988 Cardillo et al. ..... 273/161
4,961,276 A * 10/1990 Lin ..... 40/410
5,482,277 A * 1/1996 Young ..... 273/161
5,732,492 A * 3/1998 Lin ..... 40/410
5,864,976 A * 2/1999 Yang ..... 40/410
6,161,317 A * 12/2000 Wang ..... 40/406

* cited by examiner

*Primary Examiner*—J. J. Swann
*Assistant Examiner*—William L. Miller
(74) *Attorney, Agent, or Firm*—Godwin Gruber, P.C.; Arthur I. Nevarro

(57) ABSTRACT

A crystal ball or globe display system (10) including a support base (14) and a display (11) mounted to the support base (14). The globe display system (10) also includes a globe assembly (13) mounted to the support base (14), the globe assembly (13) comprising an transparent enclosure (12) surrounding the display (11). The enclosure (12) defines a space filled with a fluid, wherein the display (11) is contained within the fluid. The globe display system (10) further comprises an audio producing mechanism housed in the support base (14). The audio producing mechanism is driven by a touch sensitive mechanism which is activated upon contact with the globe assembly (13). The crystal ball or globe display system (10) is attained where the display (11) is contained in the fluid-filled globe display system (10) and adapted to activate and de-activate digital sound for entertainment and enjoyment.

18 Claims, 3 Drawing Sheets

WATER GLOBE WITH TOUCH SENSITIVE SOUND ACTIVATION

CROSS-REFERENCE TO RELATED APPLICATION

The application is commonly assigned and related to Provisional Application Serial No. 60/147,976 entitled "Water Globe With Touch Sensitive Sound Activation", by Jin K. Song, filed Aug. 6, 1999, the entirety of which is incorporated herein by reference. This application claims priority on the aforementioned related provisional application.

FIELD OF THE INVENTION

This invention relates generally to crystal ball or globe display systems, and more particularly to such a display system containing characters or scenes immersed in fluid, and music activated by touch sensitive properties.

BACKGROUND OF THE INVENTION

Without limiting the scope of the invention, its background is described in connection with water globe display and musical systems.

Substantial interest has long been given by the public to visual or audible display systems which are pleasing or exciting. These systems typically include musical and/or animated figures or characters mounted within a transparent crystal ball or globe.

Another group of display systems that have long been enjoyed by the consuming public are transparent crystal balls or globes filled with fluid, within which are contained particular scenes or objects. In addition, the fluid-filled globe or crystal ball display system may incorporate means for playing a particular tune. In the musical box or musical globe industry, it is commonly practiced for such display systems to comprise a wind-up drive means having a grippable knob and an output shaft which may be interconnected to the scenes for simultaneous movement. The means for providing music along with the fluid-filled display system exists by sealing the music producing assembly in the base of the display. In this way, the fluid contained within the crystal ball or globe is maintained completely separate from the music producing means, thereby enabling musical backgrounds to be associated with fluid-filled crystal ball or globe displays.

Furthermore, most of the fluid-filled displays also incorporate visually distinctive particles contained in the fluid which are capable of being stirred by twisting and rotating the display in its entirety. Typically, these particles comprise glitter, confetti, or white, snowflake-like material and provide additional visual stimulation as the particles fall through the fluid by gravity. Once all of the particles are completely deposited on the base, due to the pull of gravity, the process can be repeated by lifting or shaking the globe to redisperse the particles throughout the fluid.

Although crystal ball or globe display systems are extremely popular, prior art systems have not combined a fluid-filled globe or crystal ball display system with an audio producing means activated and de-activated by the human touch. In addition, a need exists for a globe display system which provides for the continuous circulation of the fluid contained within the globe assembly so as to continuously circulate any visually distinctive particles without the need for shaking, stirring, twisting, or rotating of the display in its entirety.

SUMMARY OF THE INVENTION

The present invention provides for a fluid-filled crystal ball or globe with an integrated audio producing means, such as an integrated static/electric sensor, which permits activation and de-activation of digital sound and motion within the ball or globe by the human touch.

Disclosed in one embodiment is a crystal ball or globe display system. The system comprises a support base and a display mounted to the support base. The system further comprises a globe assembly mounted to the support base, the globe assembly comprising a transparent enclosure surrounding the display. The globe assembly is further defined as comprising a transparent fluid sealed within the space defined by the transparent enclosure in a manner providing for the viewing of the display through the fluid. The fluid may comprise either glycerin, glycol, distilled water, or bacteria-free water.

The system also comprises an audio producing means housed in the support base, whereby the audio producing means is driven by sensor properties for touch sensitive activation upon contact with the globe assembly. The crystal ball or globe display system is attained where the display is contained in the fluid-filled globe and adapted to activate and de-activate digital sound for entertainment and enjoyment.

The system further comprises a rotating arm used to continuously circulate the fluid within the globe assembly providing for further enhancement of the display. The system also comprises a magnetic drive disc housed within the support base. Thus, the magnetic drive disc is adapted to cause the turning of the rotating arm upon contact with the globe assembly. Together, the rotating arm and the magnetic drive disc comprise, respectively, permanent magnets for rotating the rotational arm according to magnetic flux variations of the magnetic drive disc when the disc rotates.

The system also comprises a drive means having at least one output drive shaft which is capable of rotational motion. The drive means is an electric rotating motor which is housed in the support base and connected to the magnetic drive disc at the output shaft for rotating the disc.

The system further comprises a magnetic strip comprising a first end and a second end. The first end is immersed in the fluid within the globe assembly and coupled with electrostatic means. The second end is electrically mounted to a touch sensitive means housed in the support base. As such, the magnetic strip is adapted to transfer a touch signal to the touch sensitive means upon contact with the external wall of the globe assembly.

The system also comprises a circuitry means which is installed in the support base and adapted to control the drive means and the audio producing means with the touch sensitive means. The circuitry means further includes a touch sensitive means generating a sense signal in response to the touch signal from the magnetic strip. The sense signal has a predetermined voltage level. Thus, the touch sensitive means comprises an electrostatic-type touch sensor including an oscillation circuit oscillating with high frequency initiated by human contact with the external wall of the globe assembly. The touch sensitive means also comprises a detection circuit for detecting the inductance and capacitance variations of the oscillation circuit. Furthermore, the touch sensitive means comprises a commercial alternating current (AC) power of 60 Hz-type touch sensor including a first operational amplifier and a second operational amplifier. The first operational amplifier is for amplifying an electromagnetic wave signal of commercial power induced in the globe assembly through the human body. On the other hand, the second operational amplifier operates active states by the output of the first operational amplifier.

The circuitry means further includes an audio storage means including an integrated circuit for storing voice and sound data. The audio storage means also synthesizes the stored voice and sound data, and delivers the synthesized result in the form of an audio signal to the audio producing means.

The circuitry means also includes a motor driver, an audio producing driver, a control means and a power supply circuit. The motor driver is adapted to control an input voltage to the drive means in order to stabilize the operation of the electric rotating motor. The audio producing driver amplifies the audio signal from the audio storage means and supplies the amplified audio signal to the audio producing means. The control means, on the hand, is responsive to the sense signal from the touch sensitive means in order to control the operations of the audio storage means, the drive means and the audio producing driver. The power supply circuit is adapted to supply the desired power to the electric rotating motor, the touch sensitive means, the audio producing means, the audio storage means, the motor driver, the audio producing driver and the control means.

The system further comprises a switch means for controlling the activation and de-activation of the touch sensitive means. The switch means is further defined as comprising one selected from the group consisting of manual switches, photo cells, and motion sensors.

Disclosed in another embodiment is a crystal ball or globe display system configured to generate touch sensitive digital sound activation. A static electric sensor section is housed in the base of the crystal ball or globe display system. When the on/off switch is at the "ON" position, the sensor is in ready mode. Upon touching any section of the crystal ball or globe, digital sound is activated. Pre-recorded music, or sound is heard for a pre-determined time, or until the crystal ball or globe is contacted again for de-activation. The activation and de-activation of the digital sound is continuous as long as the on/off switch is in the "ON" position. In addition, the proposed embodiment may contain a light which is simultaneously activated and de-activated with the touch of the crystal ball or globe assembly for use as a night light or for decorative purposes. Also, the proposed embodiment may contain characters or scenes as a display which are also animated. Movement within the crystal ball or globe assembly provides for enhancing the entertainment and enjoyment of such a display system.

Technical advantages of the present invention include a fluid-filled globe or crystal ball display system including an audio producing means which is activated and de-activated by the human touch.

Another technical advantage of the present invention includes a globe display system which provides for the continuous circulation of the fluid contained within the globe assembly of the display system. In addition, this allows for the continuous circulation of any visually distinctive particles without the need for shaking, stirring, twisting or rotating of the display in its entirety.

BRIEF DESCRIPTION OF THE DRAWINGS

For a more complete understanding of the present invention, including its features and advantages, reference is made to the following detailed description of the invention in conjunction with the accompanying drawings of which.

Corresponding numerals and symbols in the figures refer to corresponding parts in the detailed description unless otherwise indicated.

DETAILED DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
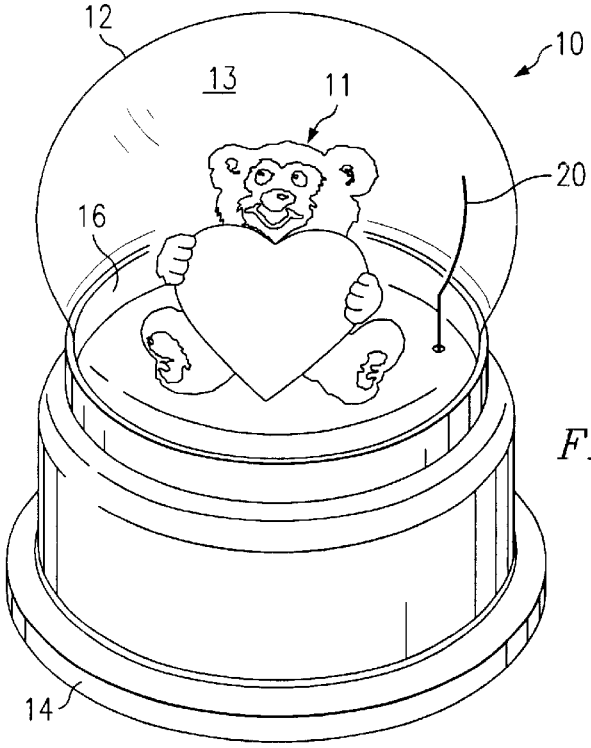
FIG. 1 illustrates a fluid-filled globe display system according to a preferred embodiment of the present invention.

To better understand the invention, reference is made to FIG. 1, which depicts a fluid-filled globe display system 10 in accordance with the preferred embodiment of the present invention. The globe display system 10 comprises a support base 14 and a display 11, which is mounted to the support base 14. The display 11 may be a figure, character or scene depicting, for example, a theme from a movie or cartoon. The display 11 further comprises openings (not shown) for use with sensor properties housed in the support base 14.

The globe display system 10 includes a globe assembly 13 which is mounted to the support base 14. The globe assembly 13 comprises a substantially rounded and transparent enclosure 12 in which the display 11 is arranged for viewing from the outside of the enclosure 12. The enclosure 12, or globe, is fitted tightly around the inner wall 16 of the support base 14 in order to form an outer wall. The globe assembly 13 is further defined as comprising a transparent fluid (e.g., water) sealed within the space defined by the transparent enclosure 12 in a manner providing for the viewing of the display through the fluid. Typically, the globe assembly 13 incorporates visually distinctive particles (not shown) contained in the fluid which are capable of being stirred by twisting and rotating the display system 10. Alternatively, a pump, rotating arm or other object can be utilized to assist in stirring the particles within the enclosure 12. Examples of such particles include glitter, confetti, or snowflakes which provide additional visual stimulation as the particles fall through the fluid in the enclosure 12.

The globe display system 10 also comprises an audio producing means housed in the support base 14. An example includes a speaker with an audio driver controlled by a sound generator. Other devices and configurations may also be employed. The audio producing means is activated by a magnetic strip 20, which is mounted to a touch sensitive means, upon contact with the outer wall, or enclosure 12, of the globe assembly 13. Thus, the crystal ball or globe display system 10 produces music and a continuous flow of the enclosed fluid when the globe assembly is touched by a person.

Figure 2:
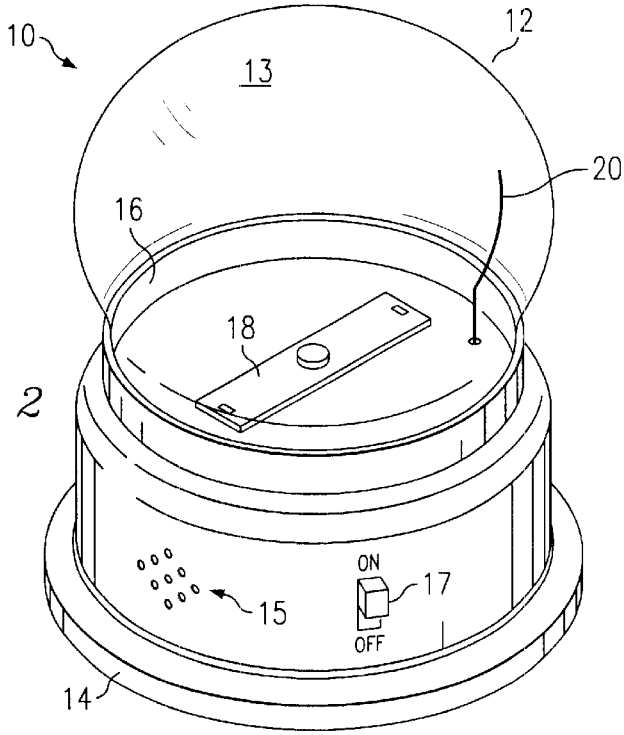
FIG. 2 shows a perspective view of a fluid-filled display system in accordance with the preferred embodiment of the present invention.

With reference to FIG. 2, a perspective view of the globe display system 10 is shown in accordance with the preferred embodiment of the present invention. The sensor properties housed in the support base 14 are operated by a power supply, which may include, for example, M batteries. The power supply is activated by an on/off switch 17. When the on/off switch 17 is in the "ON" position, contact with any portion of the enclosure 12, or globe, causes the magnetic strip 20 to activate and de-activate the rotating arm 18, as well as the digital sound controlled by sensor properties housed in the support base 14. Once the magnetic strip 20 is initiated, the rotating arm 18 begins to spin causing the circulation of the fluid sealed within the globe assembly 13. The rotating arm 18, housed under the display 11, is mounted by its center axis to the support base 14 to allow for rotating motion. The rotating arm is used to continuously circulate the fluid within the globe assembly 13 providing for further enhancement of the display 11.

In addition, if snowflake-like particles (not shown), for example, are also sealed with the fluid within the globe assembly 13, the rotating arm causes the particles to continuously circulate. This eliminates the need to shake, stir or rotate the display system 10 in its entirety. Instead, as long as the switch 17 is in the "ON" position and the globe assembly 13 has come in contact with a human's touch, the fluid and any particles within will continuously circulate via the rotating arm 18 for enjoyment and entertainment.

In one embodiment, one touch of the enclosure 12 turns a light ON within the enclosure and activates the production of digital sound, or music which is heard from a speaker 15. In addition, movement of the display 11, or characters can be initiated. A second touch or contact turns the light OFF and de-activates any sound or music, as well as ceasing any movement within the globe assembly 13. A third touch or contact will again turn the light ON, and once again activate digital sound or music from the beginning, with corresponding movement of display 11 or scenes. If no contact is made after the first touch, then the digital sound or music will continue for a pre-determined time, or until de-activated. The light and movement will also remain during the predetermined time of the digital sound or music. Such light and music allow for entertainment and enjoyment, or as a night light and form of relaxation before sleep.

If the on/off switch 17 is in the "OFF" position, then any form of contact will not activate any sound, light or movement. As a result, the power supply is conserved.

Figure 3:
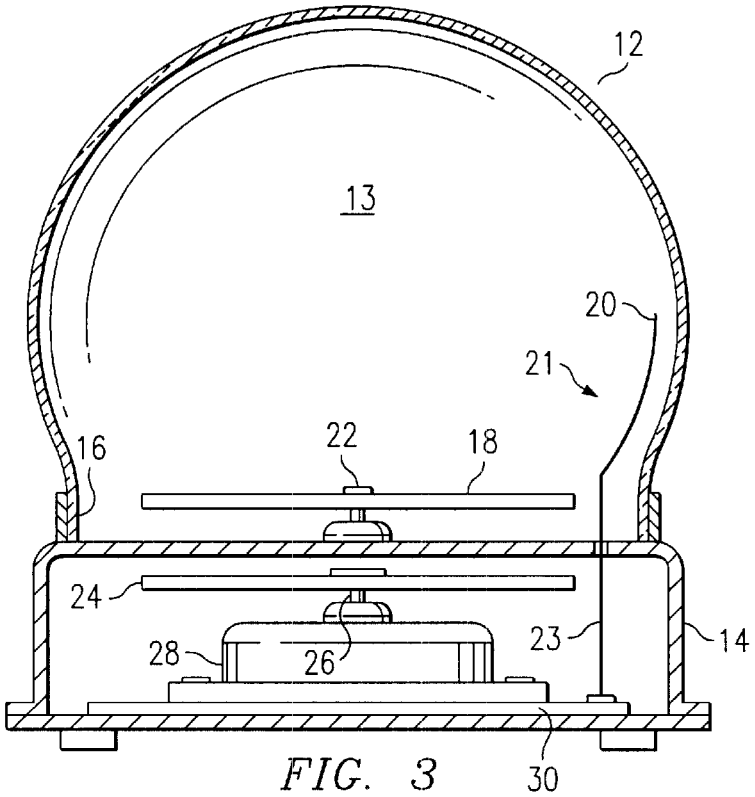
FIG. 3 is a sectional view of a fluid-filled display system in accordance with the preferred embodiment of the present invention.

With reference to FIG. 3, a brief sectional view of the display system 10 is shown in accordance with the preferred embodiment of the present invention. The sectional view shows the magnetic strip 20 as it extends from the globe assembly 13 to the support base 14. The magnetic strip 20 comprises a first end 21 and a second end 23. The first end 21 is immersed in the fluid within the globe assembly 13 and coupled with electrostatic means. The second end 23 is electrically mounted to a touch sensitive means via circuitry 30 housed in the support base 14. Thus, the magnetic strip 20 is adapted to transfer the touch signal to the touch sensitive means via the circuitry 30 upon contact with the external wall, or enclosure 12 of the globe assembly 13.

Upon touching the enclosure 12 of the globe assembly 13, a sense signal is generated by the touch sensitive means in response to the touch signal from the magnetic strip 20. The sense signal, with a predetermined voltage level, then communicates with the circuitry 30 resulting in the circulation of fluid and dispersal of music.

The circuitry 30 is communicably coupled with a drive means, or an electric rotating motor 28, which has at least one output drive shaft 26. The output drive shaft 26 is capable of rotational motion. Furthermore, the electric rotating motor 28 is housed in the support base 14 and connected to a magnetic drive disc 24 at the output shaft 26 for rotating the disc 24. Thus, because of the magnetic coupling, the rotating arm 18 rotates with the rotation of the magnetic drive disc 24. That is, the rotating arm 18 and magnetic drive disc 24 comprise, respectively, permanent magnets for rotating the rotational arm 18 according to magnetic flux variations of the magnetic drive disc 24 when the disc 24 rotates. This causes the motion of the rotating arm 18 which results in the continuous circulation of the fluid and particles sealed within the globe assembly 13.

Figure 4:
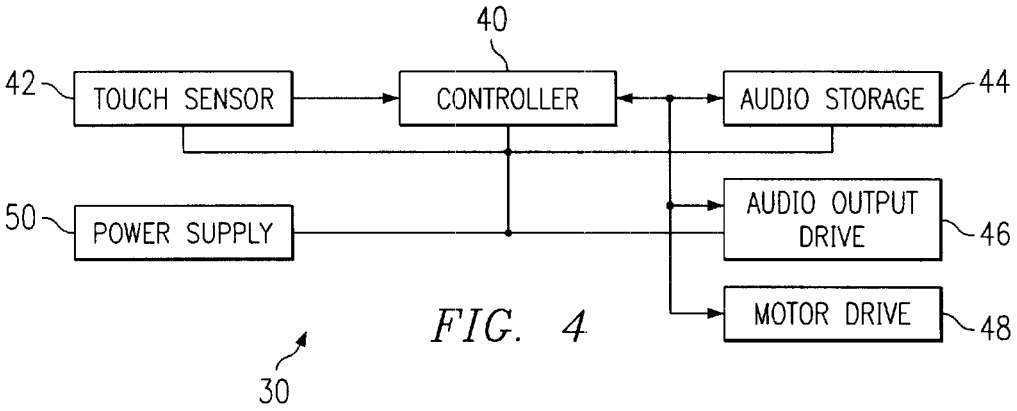
FIG. 4 is a block diagram of the circuitry of the fluid-filled display system in FIG. 1.

With reference to FIG. 4, therein is shown the circuitry 30 housed in the support base 14 as shown in FIG. 3. As previously discussed, once the on/off switch 17 is in the "ON" position and the enclosure 12, or external wall, is contacted by human touch, the static electric sensor, or touch sensor 42 is activated. That is, static electricity is transferred via the magnetic strip 20 to the touch sensor 42.

Upon activation, the controller 40, which is communicably coupled to the power supply 50, communicates simultaneously with the integral components of the display system 10. Thus, the controller 40, or control means, is responsive to the sense signal from the touch sensor 42, and controls the operations of the audio storage means 44, the motor driver means 48 and the audio output driver 46. The audio storage means 44 includes an integrated circuit for storing voice and sound data therein. Furthermore, the audio storage means 44 synthesizes the stored voice and sound data and delivers the synthesized result from the audio signal to the audio producing means. Concurrently, the audio output driver 46 amplifies the audio signal from the audio storage means 44 and supplies the amplified audio signal to the audio producing means. The pre-recorded music, for example, is then heard from the speaker 15 of the display system 10 for enjoyment and relaxation.

On the other hand, the motor driver 48 controls an input voltage to the drive means, or electric rotating motor 28, in order to stabilize the operation of the electric rotating motor 28. It is the electric rotating motor 28 which then causes the magnetic drive disc 24 to rotate, which in turn causes the rotating arm 18 to rotate via permanent magnets. Thus, a continuous circulation of fluid sealed within the globe assembly 13 is accomplished.

Figure 5:
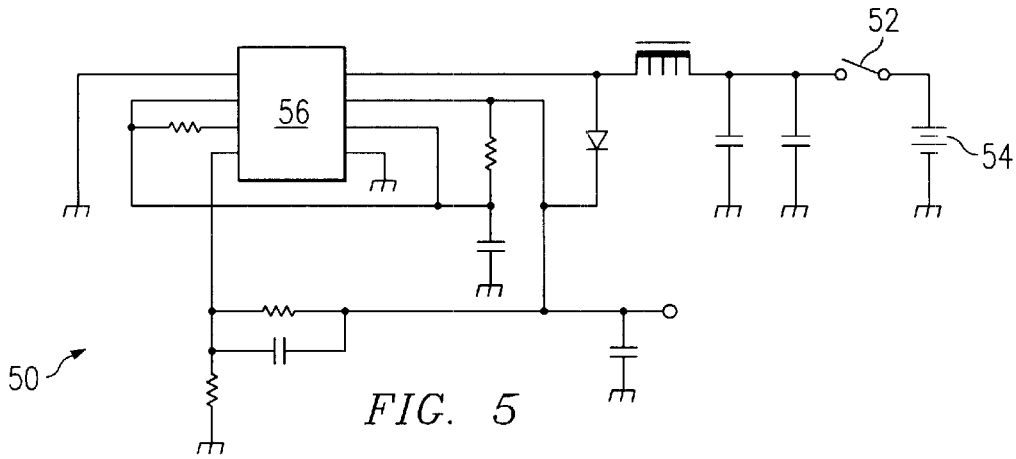
FIG. 5 is a circuit diagram of a power supply circuit.

With reference to FIG. 5, therein is shown the circuitry of the power supply 50. The power supply 50 operates if the power switch (SW1) 52 of the circuit is in the ON position. Once the switch 52 is ON, the power supply circuit 50 supplies desired power to the motor drive 48, the touch sensitive means 42, the audio producing means, the audio storage means 44 and the audio output driver 46.

In operation, a voltage of DC low level from a voltage source (B1) 54 is supplied to an oscillator (U2) 56 via a coil. This causes the oscillator (U2) 56 to oscillate at a high frequency. Therefore, the voltage from the voltage source (B1) 54 is synthesized with electric energy stored in the coil and then boosted to a high level voltage. This boosted voltage is rectified with a conventional method by a diode, smoothed by a capacitor and supplied as an operating voltage to the components in the circuitry 30.

Figure 6:
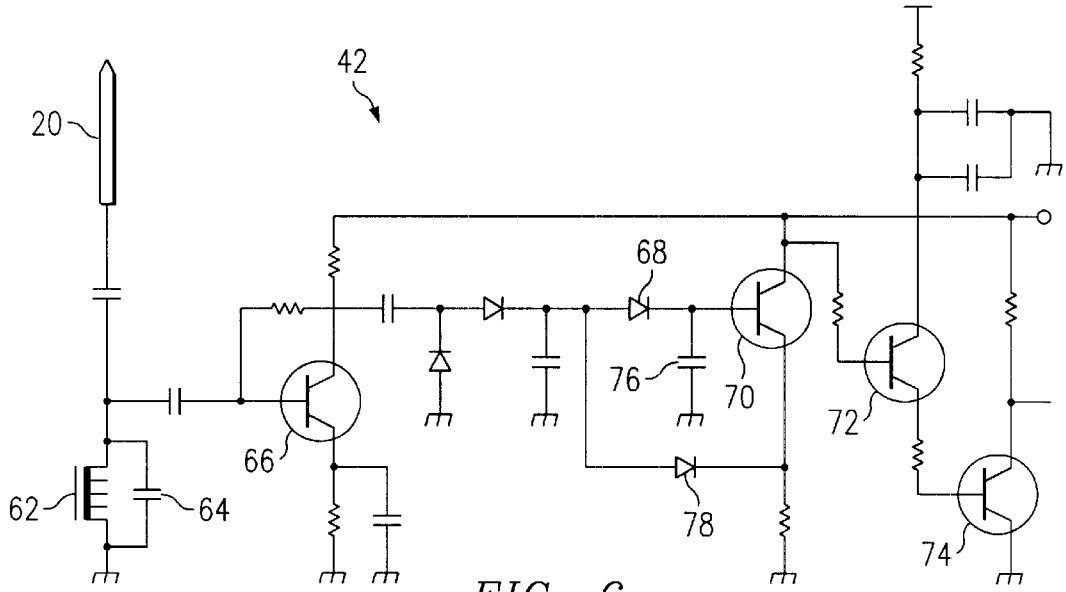
FIG. 6 is a circuit diagram of an electrostatic-type touch sensor.

The touch sensitive means which delivers the touch signal received by the magnetic strip 20 to the circuitry 30 comprises an electrostatic-type touch sensor 42 and a commercial alternating current (AC) power of 60 Hz-type touch sensor. FIG. 6 shows a circuit diagram of an electrostatic-type sensor 42. The electrostatic-type sensor 42 includes an oscillation circuit and a detection circuit. The oscillation circuit oscillates with high frequency initiated by human contact with the external wall, or transparent enclosure 12 of the globe assembly 13. The oscillation circuit further comprises a coil (L2) 62, a capacitor (C11) 64 and a transistor (Q3) 66. Once the transparent enclosure 12 of the globe assembly 13 is touched, the oscillation circuit is varied in inductance and capacitance. Thus, the detection circuit detects the inductance and capacitance variations of the oscillation circuit. As such, these variations are transferred through a capacitor, detected by a voltage double circuit, and charged on a capacitor, disposed in front of a diode (D2) 68. Noticeably, before the enclosure 12 of the globe assembly 13 is touched, a stable input voltage is applied to a base and emitted from a transistor (Q1) 70.

Figure 7:
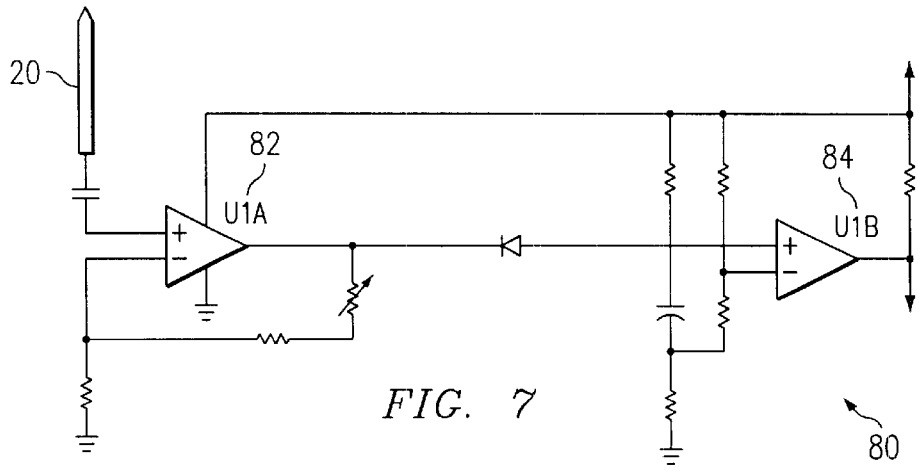
FIG. 7 is a circuit diagram of a commercial alternating current (AC) power of 60 Hz-type sensor.

With reference to FIG. 7, therein is shown a circuit diagram of a commercial alternating current (AC) power of 60 Hz-type touch sensor, denoted generally as 80, comprising a first operational amplifier (U1A) 82 and a second operational amplifier (U1B) 84. A first operational amplifier 82 is used to amplify an electromagnetic wave signal of commercial power induced in the globe assembly 13 through the human body. On the other hand, a second operational amplifier 84 operates in active state by the output of the first operational amplifier 82.

Electromagnetic waves of the same frequency are ceaselessly induced in transmission lines. Because the electromagnetic waves of 60 Hz carry relatively large power, they induce an electromagnetic field of the same frequency found in the human body when contacted. Therefore, if the human touches the transparent enclosure 12 of the globe assembly 13, the electromagnetic field causes the flow of a feeble AC signal through the human body and the enclosure 12. An input signal which is sent to a first operational amplifier (U1A) 82 is amplified according to an amplification factor determined by resistors. As a result, the voltage at a non-inverting inputterminal (+) of a second operational amplifier (U1B) 84 (i.e., detecting circuit) falls to a low level and, in turn, a voltage at an output terminal of the second operational amplifier (U1B) 84 drops to a low level. Thus, the normal state is a high level. As such, the low output voltage from the second operational amplifier (U1B) 84 is applied to the controller 40 shown in FIG. 4. In response to this low voltage, the controller 40 determines that the human body has touched the transparent enclosure 12 of the globe assembly 13 and performs the associated operations including the continuous circulation of the fluid and particles sealed within the globe assembly 13 and the emission of music via the speaker 15.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A crystal ball or globe display system comprising:

a support base;

a display mounted to said support base;

a globe assembly mounted to said support base, said globe assembly comprising a transparent enclosure surrounding said display;

a transparent fluid sealed within the space defined by said transparent enclosure in a manner providing for the viewing of said display through said fluid;

an audio producing means housed in said support base, said audio producing means driven by a touch sensitive means which is activated upon contact with said globe assembly;

a rotating arm used to continuously circulate said fluid within said globe assembly providing for further enhancing the display;

a magnetic drive disc housed within said support base adapted to cause the turning of said rotating arm upon contact with said globe assembly;

a drive means having at least one output drive shaft which is capable of rotational motion, said drive means housed in said support base and connected to said magnetic drive disc at said output shaft for rotating said disc;

a magnetic strip comprising a first end and a second end, said first end immersed in said fluid within said globe assembly and coupled with electrostatic means, said second end electrically mounted to said touch sensitive means housed in said support base, said magnetic strip adapted to transfer a touch signal to said touch sensitive means upon contact with the external wall of said globe assembly; and a circuitry means installed within said support base to control said drive means and said audio producing means with said touch sensitive means.

2. The globe display system according to claim 1 wherein said drive means comprises an electric rotating motor.

3. The globe display system according to claim 2 wherein said circuitry means further comprises:

said touch sensitive means for generating a sense signal in response to said touch signal from said magnetic strip, said sense signal having a predetermined voltage level;

audio storage means including an integrated circuit for storing voice and sound data therein, said audio storage means adapted for synthesizing said stored voice and sound data and delivering a synthesized audio signal to said audio producing means;

a motor driver for controlling an input voltage to said drive means in order to stabilize the operation of said electric rotating motor;

an audio output driver for amplifying said audio signal from said audio storage means and supplying the amplified audio signal to said audio producing means;

a control means responsive to said sense signal from said touch sensitive means for controlling the operations of said audio storage means, drive means and audio output driver; and a power supply circuit for supplying desired power to said electric rotating motor, touch sensitive means, audio producing means, audio storage means, motor driver, audio output driver and control means.

4. The globe display system according to claim 1 wherein said system further comprises a switch means for controlling the activation and de-activation of said touch sensitive means.

5. The globe display system according to claim 4 wherein said switch means is further defined as comprising one selected from the group consisting of manual switches, photo cells, and motion sensors.

6. The globe display system according to claim 1 wherein said rotating arm and magnetic drive disc comprise, respectively, permanent magnets for rotating said rotational arm according to magnetic flux variations of said magnetic drive disc when said disc rotates.

7. The globe display system according to claim 1 wherein said touch sensitive means comprises an electrostatic-type touch sensor including:

an oscillation circuit adapted for oscillating with high frequency initiated by human contact with said external wall of said globe assembly; and a detection circuit for detecting the inductance and capacitance variations of said oscillation circuit.

8. The globe assembly according to claim 1 wherein said touch sensitive means comprises a commercial alternating current (AC) power of 60 Hz-type touch sensor further comprising:

a first operational amplifier for amplifying an electromagnetic wave signal of commercial power induced in said globe assembly through the human body; and a second operational amplifier for operating active states by the output of said first operational amplifier.

9. The globe display system according to claim 1 wherein said fluid is selected from the group consisting of glycerin, glycol, distilled water, and bacteria-free water.

10. A water globe display system having a support base comprising:

a display mounted to said support base;

a globe assembly mounted to said support base, said globe assembly comprising a water-filled transparent enclosure surrounding said display;

an audio producing means housed in said support base, said audio producing means driven by a touch sensitive means which is activated upon contact with said globe assembly;

a rotating arm used to continuously circulate said water within said globe assembly upon activation of said audio producing means providing for further enhancement of the display;

a magnetic drive disc housed within said support base adapted to cause the turning of said rotating arm upon contact with said globe assembly;

a drive means having at least one output drive shaft which is capable of rotational motion, said drive means housed in said support base and connected to said magnetic drive disc at said output shaft for rotating said disc;

a magnetic strip comprising a first end and a second end, said first end immersed in said water within said globe assembly and coupled with electrostatic means, said second end electrically mounted to said touch sensitive means housed in said support base, said magnetic strip adapted to transfer a touch signal to said touch sensitive means upon contact with the external wall of said globe assembly; and a circuitry means installed within said support base to control said drive means and said audio producing means with said touch sensitive means.

11. The globe display system according to claim 10 wherein said system further comprises a lighting means adapted to be activated and de-activated upon contact with said globe assembly.

12. The globe display system according to claim 10 wherein said drive means comprises an electric rotating motor.

13. The globe display system according to claim 10 wherein said system further comprises a switch means for controlling the activation and de-activation of said touch sensitive means.

14. The globe display system according to claim 13 wherein said switch means is further defined as comprising one selected from the group consisting of manual switches, photo cells, and motion sensors.

15. The globe display system according to claim 10 wherein said circuitry means further comprises:

said touch sensitive means for generating a sense signal in response to said touch signal from said magnetic strip, said sense signal having a predetermined voltage level;

audio storage means including an integrated circuit for storing voice and sound data therein, said audio storage means adapted for synthesizing said stored voice and sound data and delivering a synthesized audio signal to said audio producing means;

a motor driver for controlling an input voltage to said drive means in order to stabilize the operation of said drive means;

an audio output driver for amplifying said audio signal from said audio storage means and supplying the amplified audio signal to said audio producing means;

a control means responsive to said sense signal from said touch sensitive means for controlling the operations of said audio storage means, drive means and audio output driver; and a power supply circuit for supplying desired power to said drive means, touch sensitive means, audio producing means, audio storage means, motor driver means, audio output driver and control means.

16. The globe display system according to claim 10 wherein said rotating arm and magnetic drive disc comprise, respectively, permanent magnets for rotating said rotating arm according to magnetic flux variations of said magnetic drive disc when said disc rotates.

17. The globe display system according to claim 10 wherein said touch sensitive means comprises an electrostatic-type touch sensor comprising:

an oscillation circuit adapted for oscillating with high frequency initiated by human contact with said external wall of said globe assembly; and a detection circuit for detecting the inductance and capacitance variations of said oscillation circuit.

18. The globe assembly according to claim 10 wherein said touch sensitive means comprises a commercial alternating current (AC) power of 60 Hz-type touch sensor further comprising:

a first operational amplifier for amplifying an electromagnetic wave signal of commercial power induced in said globe assembly through the human body; and a second operational amplifier for operating active states by the output of said first operational amplifier.

* * * * *

UNITED STATES PATENT AND TRADEMARK OFFICE

CERTIFICATE OF CORRECTION

PATENT NO. : 6,449,887 B1
DATED : September 17, 2002
INVENTOR(S) : Jin K. Song

It is certified that error appears in the above-identified patent and that said Letters Patent is hereby corrected as shown below:

Title page, Item [54] and Column 1, lines 1 and 2,
Title after "SENSITIVE" please delete "SOUND" so title reads as: -- WATER GLOBE WITH TOUCH SENSITIVE ACTIVATION --

Title page,
Item [60], Related U.S. Application Data, after "Provisional application No. 60/147,946, filed on" please change "Aug. 6, 1999" to -- Aug. 9, 1999 --

Column 1,
Line 9, after "filed" please change "Aug. 6, 1999" to -- Aug. 9, 1999 --

Signed and Sealed this

Fifteenth Day of July, 2003

JAMES E. ROGAN
*Director of the United States Patent and Trademark Office*